US006008444A

United States Patent [19]

Chesko et al.

[11] Patent Number: 6,008,444

[45] Date of Patent: Dec. 28, 1999

[54] ADJUSTABLE WEIGHT VALVE CAP

[75] Inventors: Edward H. Chesko, Willoughby; Robert J. Phillips, Eastlake, both of Ohio

[73] Assignee: United Musical Instruments U.S.A., Inc., Elkhart, Ind.

[21] Appl. No.: 09/124,544

[22] Filed: Jul. 29, 1998

[51] Int. Cl.[6] ..... G10D 7/10

[52] U.S. Cl. ..... 84/388; 84/388

[58] Field of Search ..... 84/388, 389, 390, 84/391, 392, 333, 334, 394, 387 R, 393

[56] References Cited

U.S. PATENT DOCUMENTS

| | | | |
|---|---|---|---|
| 2,320,202 | 6/1943 | Thompson | 84/388 |
| 2,794,358 | 10/1957 | Meredith | 84/388 |
| 3,030,846 | 4/1962 | Greenleaf | 84/388 |
| 3,671,011 | 6/1972 | Oguma . | |
| 3,726,173 | 4/1973 | Cortez | 84/388 |
| 4,515,061 | 5/1985 | Ferron . | |
| 4,559,859 | 12/1985 | Pilczuk | 84/394 |

FOREIGN PATENT DOCUMENTS 144 976 12/1980 Austria .

OTHER PUBLICATIONS

The Selmer Company, Inc., Genuine Selmer Accessories 1998 Showbook, Dec. 1997, 3 pages, Elkhart, Indiana.

*Primary Examiner*—Robert E. Nappi
*Assistant Examiner*—Kim Lockett
*Attorney, Agent, or Firm*—Barnes & Thornburg

[57] ABSTRACT

A valve cap apparatus is provided for use with a musical instrument having a valve case configured to receive a valve. The apparatus includes a main end cap having a first attachment portion configured to be removably coupled to an end of the valve case, and a secondary end cap having a second attachment portion configured to be removably coupled to the main end cap.

30 Claims, 2 Drawing Sheets

ADJUSTABLE WEIGHT VALVE CAP

BACKGROUND AND SUMMARY OF THE INVENTION

The present invention relates generally to musical instruments, and particularly to brass instruments having valves for changing the distance that a column of vibrating air travels before exiting the instrument. More particularly, the present invention relates to end caps for valve chambers used in brass instruments.

Brass instruments, for example trumpets, often include various tubes coupled to valves so that a musician can vary notes emanating from the instrument by operating the valves to change the distance that a vibrating air column travels within the instrument. Components of the instrument, including the valve components, are subject to sympathetic vibrations caused by the vibrating air column as it travels through the instrument. These sympathetic vibrations feed back into the vibrating column of air and affect the quality of the sound from the instrument, including both the tone and overtones, also known as color or timbre. Air column vibrations represent a wide range of frequencies which give the sound "tone" or "color". Vibrations of metal in critical areas dampen particular frequencies. Therefore, tone and color of the sounds produced change as alloys, mass and metallurgical make-up of the instrument changes vibrating characteristics of the metal.

Brass instruments therefore are designed so that the effects of vibrating components within the instrument result in desirable tone and timbre. Because the initial vibrating column of air coming into the instrument is unique to each musician, however, the particular sound quality, that is, tone and timbre, from a given brass instrument varies according to the musician. Thus, some musicians prefer an instrument with components different from standard components for that instrument, such as a mouthpiece that is about 25% heavier than a standard mouthpiece.

Valves in a brass instrument are a particular source of sympathetic vibration that affects sound quality such as tone and timbre. Valves typically include a valve case with an end cap located at one end and a valve actuator located at another end, such as a reciprocating push button for a piston valve or a rotating trigger for a rotary valve. Like the heavier weight mouthpieces, some musicians prefer heavier weight valve components, which can be created using a heavier weight valve end cap. Because the effect on sound quality created by changing the weight of the valve end cap varies between individuals, musicians would welcome a system that allows for readily changing the weight of the valve end cap to suit a particular musician's needs.

According to the present invention, a valve cap apparatus is provided for use with a musical instrument that has a valve case. The apparatus includes a main end cap configured to be removably coupled to an end of the valve case and a secondary end cap configured to be removably coupled to the main end cap.

According to another aspect of the invention, the instrument is a brass instrument such as a trumpet. According to yet another aspect, the valve case is a piston valve case. According to still another aspect, the main end cap has a greater mass than the secondary end cap. According to still another aspect, a third end cap is provided that can be coupled to either the main or secondary cap. The third cap can be coupled to the secondary cap when the secondary cap is coupled to the main cap, and the second and third caps can be substantially identical.

According still yet other aspects of the invention, the main cap includes an air passageway and the secondary cap includes an air passageway that is in fluid communication the main cap air passageway when the main and secondary caps are coupled together. An end of the valve case can be threaded and the main cap can be configured to engage the threaded end. The end of the valve case can be threaded on an outer surface.

According to another aspect of the invention, the main cap is threaded and the secondary cap is configured to engage the main cap threads. According to yet other aspects of the invention, the threaded region on the main cap can be formed on a wall that defines an air passageway through the main cap, and the secondary cap includes a threaded post configured to engage the threaded portion of the main cap. According to still another aspect, the threaded post includes an air passageway in communication with the air passageway of the main cap.

According to still yet another aspect of the invention, a proximal portion of the main cap is coupled to the valve case and a thickened distal portion provides additional weight. Similarly, the secondary cap can include a proximal portion that is coupled to the main cap and a thickened distal portion that provides additional weight.

According to another aspect of the invention, the main cap includes a finger-engaging surface to facilitate gripping the main cap when coupling the main cap to the valve case. The finger-engaging surface can be a knurled surface. The secondary cap can include a finger-engaging surface to facilitate gripping the secondary cap when coupling the secondary cap to the main cap, and, similarly, this finger-engaging surface can be a knurled surface.

Further according to the present invention, a brass instrument is provided. The brass instrument has a mouthpiece, a first tube coupled to the mouthpiece, a bell, a second tube coupled to the bell, and at least one valve coupled between the first and second tubes. An adjustable end cap is coupled to the at least one valve. The end cap includes a main cap coupled to a distal end of a valve case and a secondary cap coupled to the main cap.

According to other aspects of the invention, the instrument is a brass instrument such as a trumpet and the valve case is a piston valve case. According to yet another aspect, a third end cap is provided to be coupled to either the main or secondary cap. The third cap can be coupled to the secondary cap when the secondary cap is coupled to the main cap, and the second and third caps can be substantially identical.

According to still another aspect of the invention, a kit is provided for adjusting a mass of a metal musical instrument having a valve case configured to receive a valve. The kit includes a plurality of end caps configured to be coupled to a distal end of the valve case and to other end caps in order to permit incremental adjustment of the mass of the valve case by coupling selected end caps to the valve case. According to yet still another aspect, the plurality of end caps includes a main end cap and a secondary end cap, and the main end cap has more mass than the secondary end cap.

According to another aspect of the invention, the plurality of end caps are formed to include air passageways. According to yet another aspect, the plurality of end caps can include male and female threaded portions to permit the end caps to be coupled to the distal end of the valve case and to an adjacent end cap. The plurality of end caps can have different masses.

Additional features of the invention will become apparent to those skilled in the art upon consideration of the following detailed description of the presently perceived best mode of carrying out the invention.

BRIEF DESCRIPTION OF THE DRAWINGS

The detailed description particularly refers to the accompanying figures in which.

DETAILED DESCRIPTION OF DRAWINGS

Figure 1:
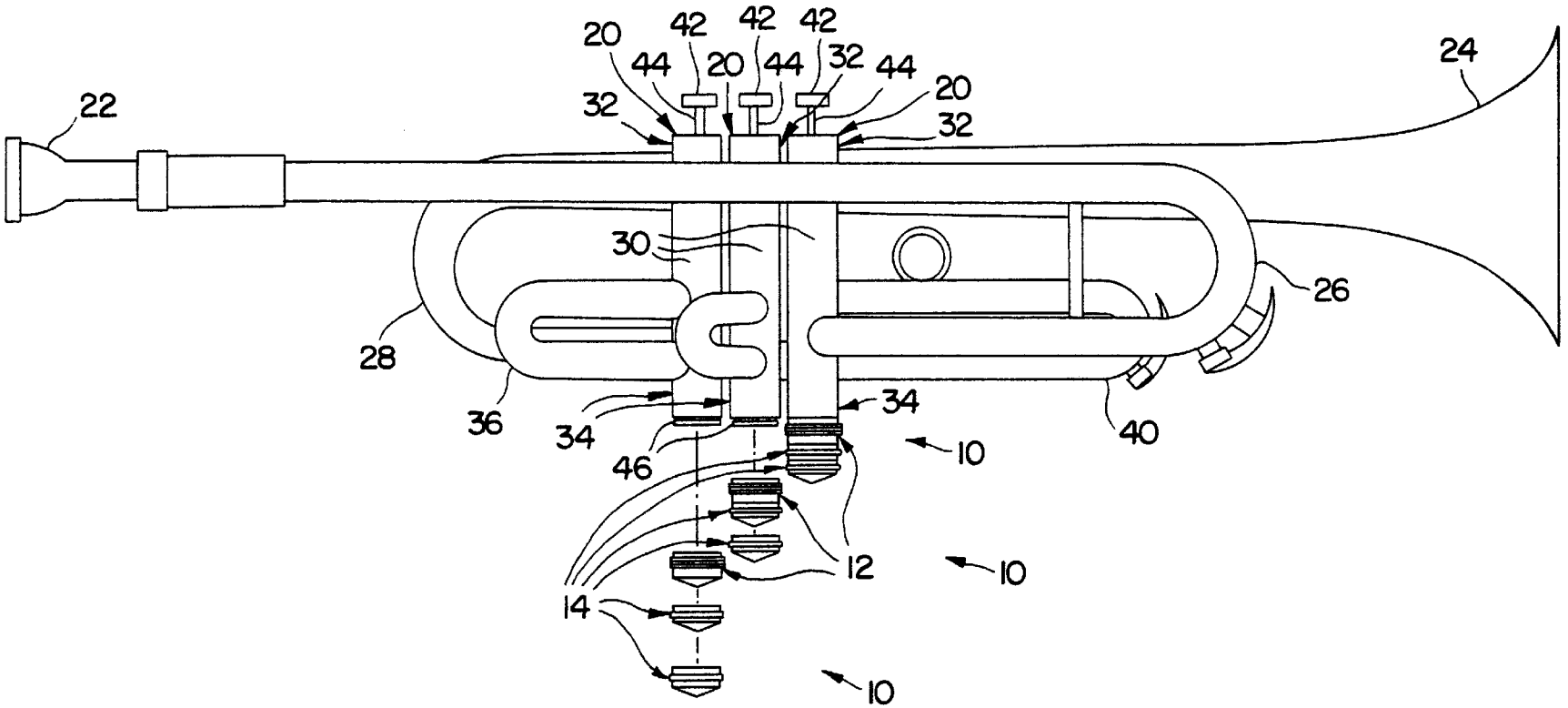
FIG. 1 is a side view of a trumpet including piston valves and valve end cap assemblies according to the present invention having main and secondary end caps configured to be coupled to a valve housing.

A valve end cap assembly 10 according to the present invention includes main and secondary end caps 12, 14 that are configured to be coupled to a valve cluster 16 of a trumpet 18 as best shown in FIG. 1. Valve cluster 16 includes three piston valves 20 that are used to change the length through which a vibrating column of air travels through trumpet 18 to achieve a desired musical sound. End cap assemblies 10 provide a versatile mechanism for adjusting sound quality of trumpet 18 by allowing a musician to influence sympathetic vibrations selectively within valves 20 that affect the resulting tone and timbre of the instrument. The musician couples a desired number of secondary end caps 14 to a main end cap 12 to alter the mass of assembly 10 which in turn creates a desired effect on sympathetic vibrations within valves 20 to adjust the tone and timbre of the vibrating column of air emitted from trumpet 18.

Trumpet 18 includes a mouthpiece 22, a bell 24, a first U-shaped tube segment 26 coupled between mouthpiece 22 and valve cluster 16, and a second U-shaped tube segment 28 coupled between bell 24 and valve cluster 16 as shown in FIG. 1. Each of the three valves 20 of valve cluster 16 includes a valve case 30 having a top end 32 and a bottom end 34. Each valve 20 is coupled to one of U-shaped tubes 36, 38, 40, which provide for changing the distance a vibrating column of air travels through trumpet 18.

Each valve 20 further includes a valve button 42 coupled to a stem 44 for reciprocally moving a valve piston (not shown) used to selectively route the vibrating column of air through one or more of the respective U-shaped tubes 36, 38, 40. Valve case 30 illustratively includes external threads 46 at bottom end 34 to provide for removably attaching end cap assembly 10.

Figure 2:
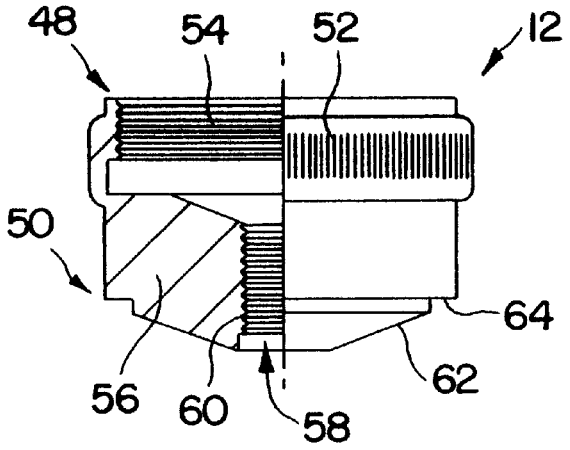
FIG. 2 is a side view of a main end cap of the valve end cap assembly of FIG. 1 with a portion cut away to show internal threads for coupling to the valve housing and a threaded aperture for coupling to a secondary end cap.

Main end cap 12 has top and bottom ends 48, 50 as best shown in FIG. 2. Main end cap 12 is illustratively made from the same material as trumpet 18, such as brass or silver-plated brass, although any suitable material can be used. Top end 48 is configured with a raised, knurled collar 52 to facilitate gripping main end cap 12 and an internal threaded portion 54 configured to engage external threads 46 on valve case 30.

Bottom end 50 of main end cap 12 is illustratively formed with a thickened region 56 that advantageously provides for increased mass of main end cap 12, which reduces sympathetic vibrations from end cap assembly 10 and results in desirable tone and timbre from trumpet 18. Bottom end 50 further includes an aperture 58 which performs two functions. First, in piston valves, opening 58 allows for air to enter and exit valve case 30 as the valve piston moves up and down to prevent air pressure differentials from impeding movent of the valve piston. Second, a threaded region 60 adjacent opening 58 provides a mechanism to allow a secondary end cap 14 to be coupled to main end cap 12 to provide for selectively increasing the mass of end cap assembly 10. Bottom end 50 furthermore is formed with a distal, annular, beveled surface 62 and a circumferential ledge 64.

Figure 3:
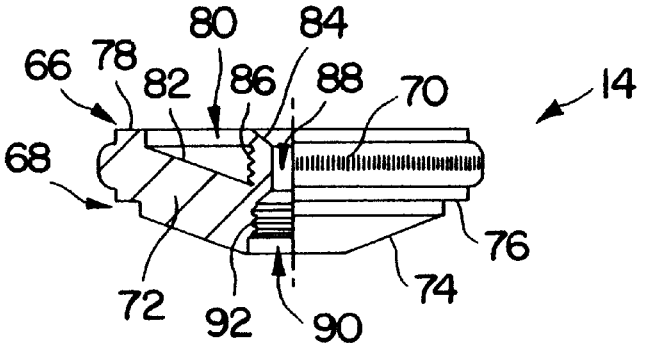
FIG. 3 is a side view of a secondary end cap of the valve end cap assembly of FIG. 1 with a portion cut away to show a threaded stud portion for coupling to the threaded aperture of the main end cap and a threaded aperture for coupling to another secondary end cap.
Figure 4:
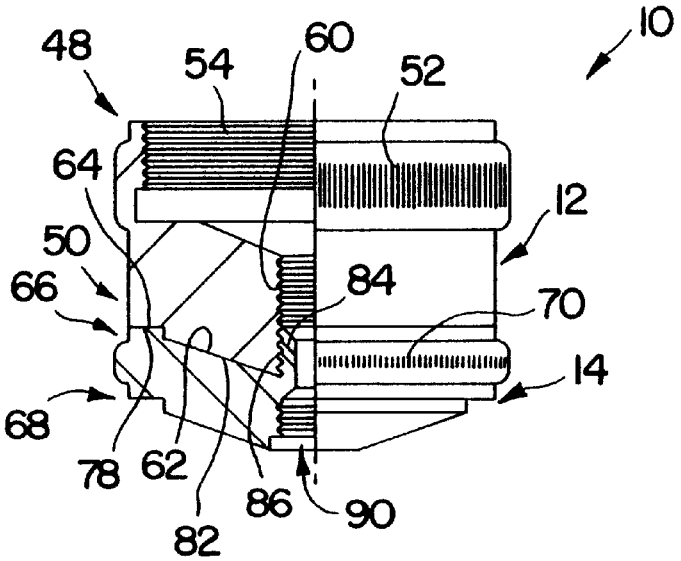
FIG. 4 is a side view showing the main and secondary end caps of FIGS. 2 and 3 coupled together.

Secondary end cap 14 includes top and bottom ends 66, 68 as best shown in FIG. 3 and is configured to be easily coupled to and uncoupled from main end cap 12 as shown in FIG. 4. Secondary end caps can also be removably coupled to each other as shown in FIG. 1.

Similar to main end cap 12, secondary end cap 14 is illustratively made from the same material as trumpet 18 and includes an external, raised, knurled collar 70 that provides a convenient gripping surface as well as providing aesthetic qualities. Bottom end 68 also includes a thickened region 72 that provides for increased mass to further reduce sympathetic vibrations and achieve desirable tone and timbre. Bottom end 68 furthermore includes a beveled surface 74 and ledge 76 similar to beveled surface 62 and ledge 64 of main end cap 12.

Top end 66 of secondary cap 14 is formed with an annular top ledge 78 configured to engage ledge 64 of main end cap 12 or ledge 76 of another secondary end cap 14. Top end 66 further includes an opening 80 and an internal beveled surface 82 configured to engage beveled surface 62 of main end cap 12 or beveled surface 74 of another secondary end cap 14. Secondary end cap furthermore includes an annular upstanding post 84 having external threads 86 and an aperture 88 extending therethrough. Post 84 is threaded into aperture 58 so that secondary end cap threads 86 engage threaded region 60 to removably couple secondary end cap 14 to main end cap 12.

Bottom end 68 of secondary end cap 14 includes an aperture 90 and an internal threaded portion 92 substantially identical to aperture 58 and threaded portion 60 of main end cap 12. Apertures 88, 90 of secondary end cap 14 are in fluid communication with each other. Secondary end cap 14 is thus configured to engage threaded upstanding post 84 of another secondary end cap 14, allowing for chaining together of an arbitrary number of secondary end caps 14 to achieve a desired mass and thus a desired effect on the tone and timbre of the vibrating column of air passing through valve cluster 16.

When main and secondary end caps 12, 14 are coupled together, secondary end cap apertures 88, 90 are in fluid communication with main end cap aperture 58 so that reciprocal movement of the valve piston is facilitated.

Main end cap 12 is illustratively configured with a weight of about 0.7 ounces and secondary end caps are illustratively configured with a weight of about 0.4 ounces, although it is understood that other weights can be provided. Furthermore, although the illustrated embodiment provides for substantially identical secondary end caps 14, a variety of end caps each having a different mass can be provided.

Similarly, although end caps 12, 14 are illustratively formed from the same material as trumpet 18, end caps 12, 14 can be formed of different materials to achieve a desired effect on the resulting tone and timbre from trumpet 18. For example, a very stiff material such as titanium can be used, or a soft material such as lead, or other materials such as composites or alloys can be used. Further, one or more surfaces of end caps 12, 14 can be coated with a material to influence the sympathetic vibrations of end cap assembly 10 and the effect on sound from trumpet 18.

Because tone and timbre from the same instrument varies from musician to musician, end cap assembly 10 according to the present invention advantageously provides musicians with a tool to vary the sound as desired to suit individual needs and preferences. Using the end cap assembly of the present invention, a musician is capable of increasing the mass of the valve cluster 16 incrementally. Therefore, a musician can simply add the main end cap 12 and as many secondary end caps 14 as desired to adjust the "tone" and "color" of the instrument. The musician can easily adjust the "tone" and "color" of the instrument based on the style of music being played or the preferences of the musician. The coupling mechanisms of end caps 12, 14 and the ability to provide different configurations by incrementally adding components to end cap assembly 10 facilitates a virtually infinite range of adjustment to sound quality.

Thus, the present invention provides an end cap assembly 10 suitable for use with valves in brass instruments, such as piston valves, so that a musician can adjust the quality of sound in a very convenient and flexible manner. Although the end caps of FIGS. 1–4 are configured for use with a trumpet, such end caps can readily be adapted to other instruments such as cornets, tubas, french horns, flüglehorns, and the like. Furthermore, although the detailed description discusses end caps on piston valves in brass instruments, adjustable weight caps can be used in other configurations, such as end caps for rotary valves.

Therefore, although the invention has been described in detail with reference to a certain illustrated embodiment, variations and modifications exist within the scope and spirit of the present invention as described and defined in the following claims.

What is claimed is:

1. A valve cap apparatus for use with a musical instrument having a valve case configured to receive a valve, the apparatus comprising a main end cap having a first attachment portion configured to be removably coupled to an end of the valve case, and a secondary end cap having a second attachment portion configured to be removably coupled to the main end cap.

2. The apparatus of claim 1, wherein the instrument is a trumpet.

3. The apparatus of claim 1, wherein the valve case is a piston valve case.

4. The apparatus of claim 1, wherein main end cap has a first mass and the secondary end cap has a second mass less than the first mass.

5. The apparatus of claim 1, further comprising a third end cap having a third attachment portion configured to be coupled to one of the main cap and secondary cap.

6. The apparatus of claim 5, wherein the third attachment portion of the third cap is configured to be coupled to the secondary cap when the secondary cap is coupled to the main cap.

7. The apparatus of claim 5, wherein the secondary cap and third cap have a substantially identical configuration.

8. The apparatus of claim 1, wherein the main cap is formed to include an air passageway.

9. The apparatus of claim, wherein the secondary cap is formed to include an air passageway which is in fluid communication the main cap air passageway when the secondary cap is coupled to the main cap.

10. The apparatus of claim 1, wherein the valve case has a distal end including a threaded portion and the first attachment portion of the main cap is configured to engage the threaded portion.

11. The apparatus of claim 10, wherein the valve case distal end is threaded on an outer surface of the valve case.

12. The apparatus of claim 1, wherein the main cap is formed to include a threaded portion and the second attachment portion of the secondary cap includes a threaded portion configured to engage the main cap threaded portion.

13. The apparatus of claim 12, wherein the threaded portion of the main cap is formed on a wall defining an air passageway through the main cap.

14. The apparatus of claim 13, wherein the secondary cap includes a threaded post configured to engage the threaded portion of the main cap.

15. The apparatus of claim 14, wherein the post of the secondary cap is formed to include an air passageway therethrough in communication with the air passageway of the main cap.

16. The apparatus of claim 1, wherein the main cap includes a proximal portion configured to be coupled to the valve case and a thickened distal portion configured to provide additional weight.

17. The apparatus of claim 1, wherein the secondary cap includes a proximal portion configured to be coupled to the main cap and a thickened distal portion configured to provide additional weight.

18. The apparatus of claim 1, wherein the main cap includes a finger-engaging surface to facilitate gripping the main cap when coupling the main cap to the valve case.

19. The apparatus of claim 18, wherein the finger-engaging surface comprises a knurled surface.

20. The apparatus of claim 1, wherein the secondary cap includes a finger-engaging surface to facilitate gripping the secondary cap when coupling the secondary cap to the main cap.

21. The apparatus of claim 20, wherein the finger-engaging surface comprises a knurled surface.

22. A brass instrument comprising:

a mouthpiece;

a first tube coupled to the mouthpiece;

a bell;

a second tube coupled to the bell;

at least one valve coupled between the first and second tubes; and an adjustable end cap coupled to the at least one valve, the end cap including a main cap having a first attachment portion configured to be coupled to an end of a valve case and a secondary cap having a second attachment portion configured to be coupled to the main cap.

23. The apparatus of claim 22, wherein the instrument is a trumpet.

24. The apparatus of claim 22, wherein the valve is a piston valve.

25. The apparatus of claim 22, further comprising a third cap having a third attachment portion configured to be coupled to one of the main cap and secondary cap.

26. A kit for adjusting a mass of a metal musical instrument having a valve case configured to receive a valve therein, the kit comprising a plurality of end caps, each end cap having an attachment portion configured to be coupled to a distal end of the valve case and to other end caps to permit incremental adjustment of the mass of the valve case by coupling selected end caps to the valve case.

27. The apparatus of claim 26, wherein the plurality of end caps includes a main end cap having a first mass and a secondary end cap having a second mass, the second mass being less than the first mass.

28. The apparatus of claim 26, wherein the plurality of end caps are formed to include air passageways therethrough.

29. The apparatus of claim 26, wherein the plurality of end caps include male and female threaded portions to permit the end caps to be coupled to the distal end of the valve case and to an adjacent end cap.

30. The apparatus of claim 26, wherein the plurality of end caps have different masses.

* * * * *